United States Patent [19]

Beckett, Jr.

[11] Patent Number: 4,896,595

[45] Date of Patent: Jan. 30, 1990

[54] PRINT HEAD AND BACKER PLATE ASSEMBLY FOR CARTON MARKER

[75] Inventor: Thomas A. Beckett, Jr., Merchantville, N.J.

[73] Assignee: Adco-Applied Development Co. Inc., Manahawkin, N.J.

[21] Appl. No.: 322,179

[22] Filed: Mar. 13, 1989

Related U.S. Application Data

[63] Continuation-in-part of Ser. No. 122,032, is a continuation-in-part of Ser. No. 930,865, Nov. 14, 1986, abandoned.

[51] Int. Cl.[4] ..... B41F 17/24

[52] U.S. Cl. ..... 101/44; 101/305; 101/348; 101/380; 101/401.3

[58] Field of Search ..... 101/35, 41, 44, 333, 101/334, 348, 379, 305, 310, 314, 315, 324, 326, 401.3, 380, 391

[56] References Cited

U.S. PATENT DOCUMENTS

| | | | |
|---|---|---|---|
| 234,433 | 11/1880 | Shedlock | 101/348 |
| 1,242,918 | 10/1917 | Burns | 101/379 X |
| 1,906,094 | 4/1933 | Powell | 101/379 |
| 2,559,455 | 7/1951 | Meyer | 101/44 |
| 2,627,803 | 2/1953 | Pannier | 101/391 X |
| 2,936,702 | 5/1960 | Columbus et al. | 101/44 |
| 3,141,406 | 7/1964 | Weinland | 101/391 |
| 3,244,097 | 4/1966 | McRae et al. | 101/334 |
| 3,724,369 | 4/1973 | Gery et al. | 101/41 X |
| 4,033,254 | 7/1977 | Tobey et al. | 101/44 |
| 4,136,421 | 8/1979 | Sihota | 101/41 |
| 4,323,011 | 4/1982 | Hamilton | 101/305 |
| 4,580,496 | 4/1986 | Buan et al. | 101/314 X |
| 4,694,747 | 9/1987 | Marozzi | 101/333 X |

FOREIGN PATENT DOCUMENTS

| | | | |
|---|---|---|---|
| 814791 | 3/1981 | U.S.S.R. | 101/315 |
| 2110600 | 6/1983 | United Kingdom | 101/333 |

*Primary Examiner*—Clifford D. Crowder
*Attorney, Agent, or Firm*—Frederick J. Olsson

[57] ABSTRACT

A marking machine for automatically marking cartons passing on an intermittently moving conveyor includes a printing head cyclically moved by a pneumatic cylinder into engagement with the cartons. The motion of the printing head is controlled by guide elements extending from the printing head cooperating with slots in adjacent side plates. The printing head passes durng its cyclical movement across an ink roll disposed above the side plates. A backer plate drops behind the carton surface to be marked just before the printing stroke of the print head. The movement of the backer plate is provided by the guide elements extending from the printing head. The type face on the printing head can be oriented to face upwardly for marking the side of the cover of an egg carton or be oriented to face downwardly for marking a separator in a filler flat.

24 Claims, 5 Drawing Sheets

PRINT HEAD AND BACKER PLATE ASSEMBLY FOR CARTON MARKER

BACKGROUND OF THE INVENTION

This application is a continuation-in-part of my copending application Ser. No. 122,032 filed 11/17/87, which was a continuation-in-part of Ser. No. 930,865 filed 11/14/86, both now abandoned.

The present invention relates generally to marking or printing apparatus and relates more particularly to apparatus for automatically applying printed indicia to articles passing along an intermittently moving conveyor. The present device is particularly suited for use with automatic egg packaging machinery for marking egg cartons.

In many fields and particularly the food packaging industry, it is necessary to mark the product or the container with the packaging date, the identity of the plant and/or other information. Such marking typically enables the seller or purchaser to correctly gauge the shelf life of the product and also to readily locate the source of the product should such a need arise.

In the packaging of eggs, which has become increasingly automated, each carton must bear a "sell by" date and this date is affixed to the carton at the time the eggs are packaged in the processing plant. On egg cartons of the type which can be divided in half, the critical date is .imprinted on both ends of the carton.

One device for carrying out such a function is shown in U.S. Pat. No. 4,252,061, issued Feb. 24, 1981, wherein a dating wheel bearing inked type face on its peripheral cylindrical surface engages the item to be marked as the item passes in contact with the wheel. Although in the patent the wheel movement is derived from engagement with the moving item to be marked, commercial variations of this type of printer have embodied a motor drive for rotating the wheel at the proper time and speed to cooperate with the moving item to be marked.

Although rotary type markers are adequate for some purposes such as rigid cartons which pass the marking station with a flat surface perpendicular to the marking roller, they are not ideal for marking the ends of egg cartons which typically involve beveled or otherwise irregular surfaces. Furthermore, egg cartons do not provide a rigid surface due to the inherent flexibility of the carton construction. The popular plastic foam cartons are particularly difficult to mark in this respect in view of their light weight and resilient nature.

Efforts have been made to develop a marking device for egg cartons which introduces a temporary backing plate into the carton to support the carton during engagement thereof by a reciprocating printing element. One such device is presently available as an integral part of an egg processing system but is cyclically driven by the carton advancing mechanism and thus is not adaptable to usage with other types of equipment. The mentioned device further suffers from a complexity of drive links and levers thus resulting in an expensive device to manufacture. Other disadvantages of this known equipment include the inconvenient location of the ink supply as well as the difficult and time consuming procedure required for changing the type. Furthermore, this type of device is limited as to type of equipment on which it can be used and its position on that equipment is restricted.

BRIEF SUMMARY OF THE INVENTION

The present invention comprises a pneumatic marking machine particularly suited for the marking of semi-rigid cartons such as egg cartons made of fiber or plastic foam. The device includes a base member including a pair of upstanding spaced parallel side plates. A print head is disposed between the side plates for rotational and translational movement, the print head being guided in these movements by slot means in the side plates cooperating with front and rear guide elements extending laterally from the print head. A pneumatic cylinder or other linear actuating means is connected to the print head to actuate the print head through its rotational and translational movements.

In its forward most printing position, the print head advances beyond the forward end of the side plates to impress the type face against a carton disposed in close proximity to the side plates. Upon further actuation of the cylinder, the print head is retracted rearwardly until the rear guide elements are restrained by the slot means, whereupon the printing head rotates about the rear guide element with the type face moving upwardly to engage an inking roller supported above the side plates. Following positioning of a successive carton adjacent the forward end of the side plates, the cylinder is again actuated and the print head bearing the inked type first rotates downwardly and then advances forwardly to press the type face against the carton surface.

To provide support for the carton surface during the printing stroke of the print head, a backing plate is intermittently lowered into a position behind the carton surface to be marked. The mechanism for positioning the backer plate comprises a pair of backer plate support arms extending adjacent and exteriorly of the side plates which are each pivotally mounted at the rear of the side plates. The arms are connected at their forward end to the backer plate and are driven in pivotal movement by means of extending portions of the print head forward guide elements which extend into linear slots in the arm members. Pivotal movement of the print head about the rear guide pins accordingly results in a simultaneous pivotal movement of the backer plate support arms and backer plate. The backer plate accordingly drops into its backing position behind the carton wall prior to the forward translational movement of the print head, thus providing a backing support for the wall during the printing stroke of the print head.

In view of the location of the inking roll above the side plates as well as the rotation of the print head upward to engage the inking roll, these elements are readily accessible to permit changing of the type face and to service the inking roll. A slide-in type holder may be quickly withdrawn or replaced to permit rapid changes of the printing type. The driving of the device by a single pneumatic cylinder permits its actuation by a carton triggered switch located on the carton conveyor. The device may accordingly be readily mounted on any intermittently operated carton conveying mechanism.

It is accordingly a first object of the invention to provide an automatic marking machine for applying printed indicia to items such as cartons passing along an intermittently moving conveyor.

Another object of the present invention is to provide a marking device as described suited for use with light weight flexible cartons such as egg cartons and the like.

Another object of the invention is to provide a device as described which provides support for the portion of the carton being marked during the marking interval A further object of the invention is to provide a marking device as described which may be actuated by a single reciprocating drive means such as a pneumatic cylinder.

A still further object of the invention is to provide a device as described wherein the type face and ink roll are easily accessible and readily changeable with a minimal interruption of the marking process.

Still another object of the invention is to provide a device as described which can be used with any type of conveyor mechanism without modification thereof.

A still further object of the invention is to provide a device as described of a relatively simply construction which can be economically manufactured, installed and serviced.

Additional objects and advantages of the invention will be more readily apparent from the following detailed description of a preferred embodiment thereof.

DESCRIPTION OF THE PREFERRED EMBODIMENT

Figure 1:
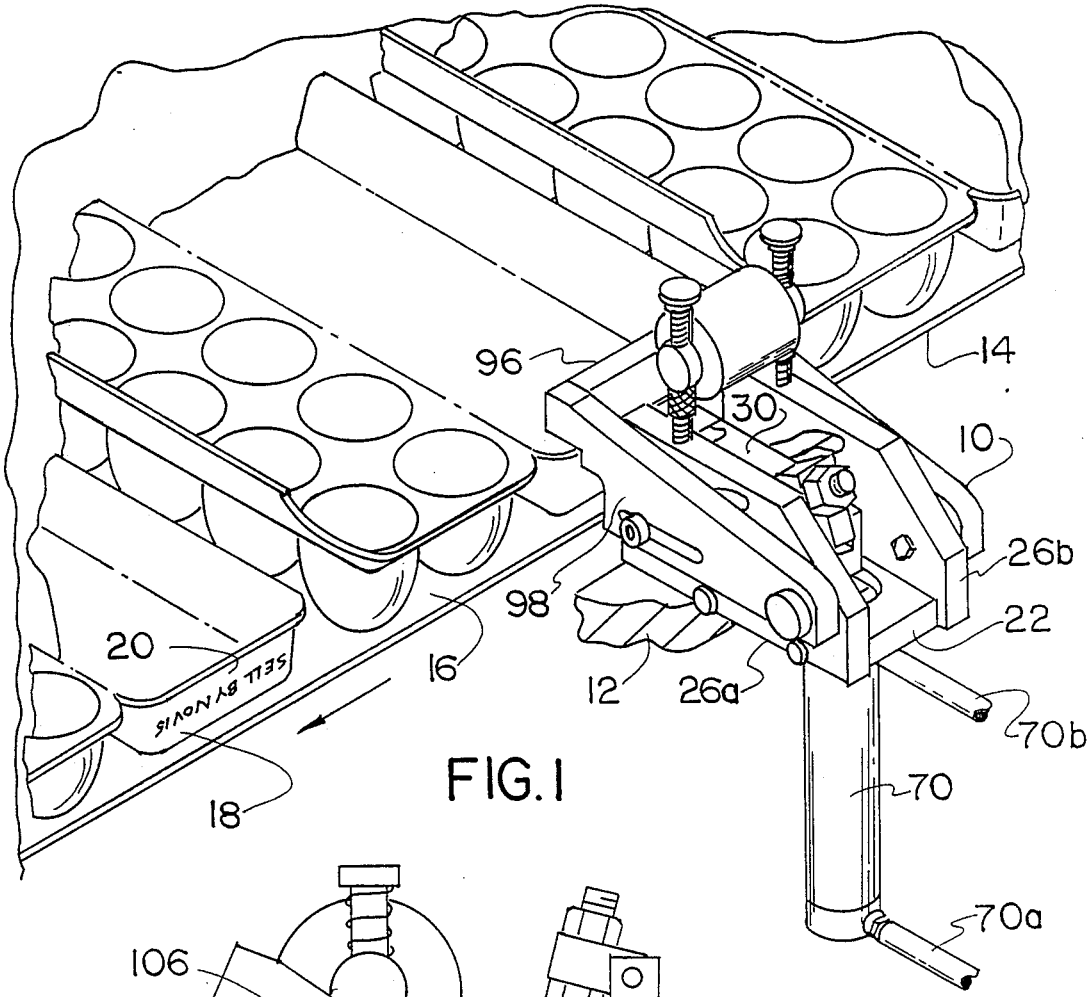
FIG. 1 is a perspective view showing a marking device in accordance with the present invention employed in conjunction with an egg carton conveyor for sequentially marking the tops of the cartons.

Referring to the drawings and particularly FIG. 1 thereof, a marking machine generally designated 10 in accordance with the present invention is shown mounted to a frame member 12 of an egg carton conveyor schematically illustrated at 14. The conveyor 14 serves to intermittently advance the empty open egg cartons 16 to the left as viewed in FIG. 1, and is controlled to sequentially position the cartons with the open lid 18 thereof adjacent to the marking machine 10 to permit the imprinting of indicia on the end of the carton top as illustrated at 20 on the left most carton. A pressure sensitive pneumatic switch (not shown) may be utilized to sense the presence of a carton in the proper marking position adjacent the marking machine and trigger the marking cycle of the machine.

Figure 2:
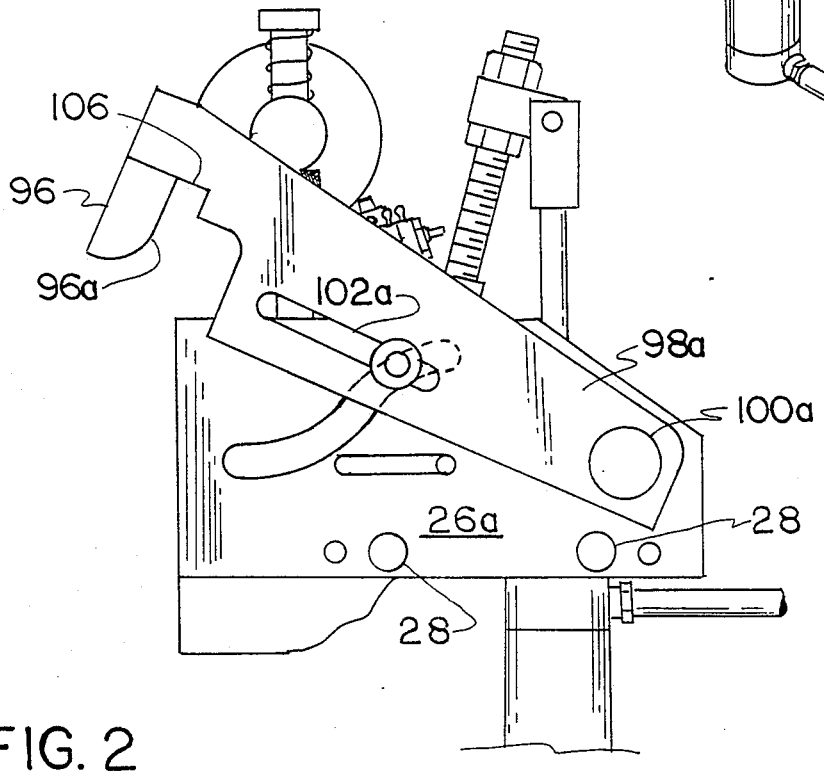
FIG. 2 is an enlarged side elevational view of the marking machine shown in FIG. 1 with the mechanism in the ready raised position.
Figure 3:
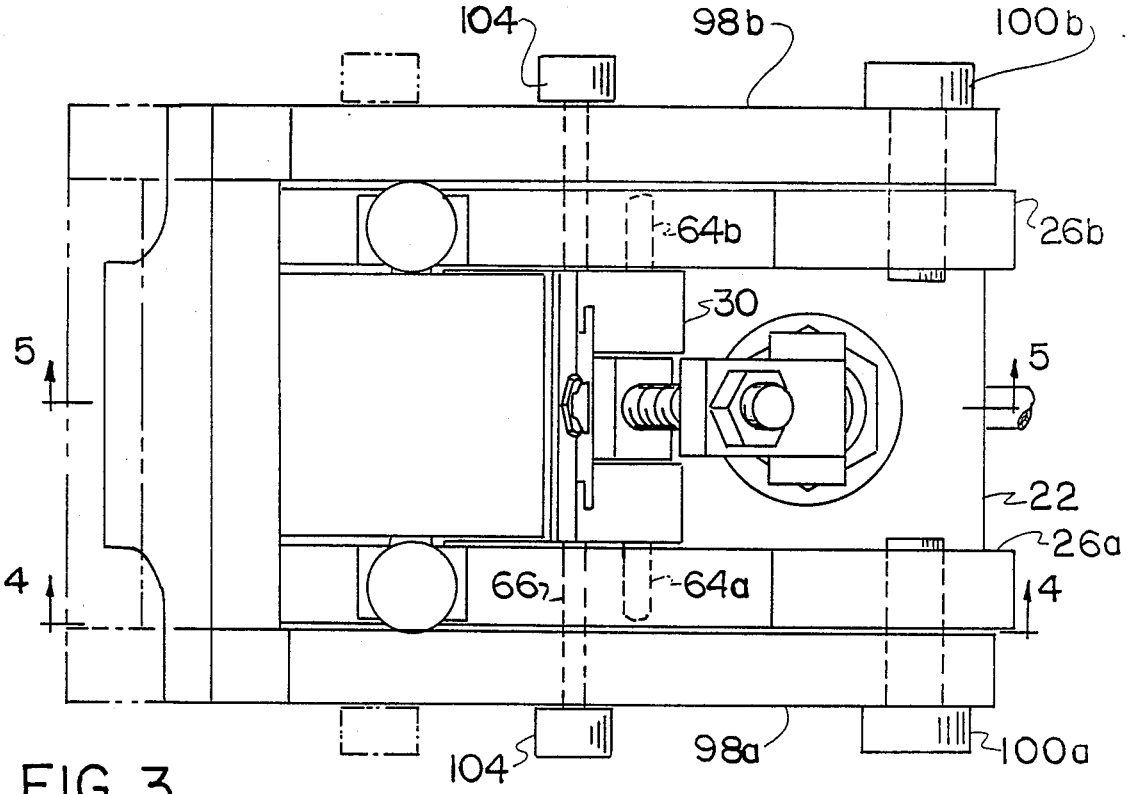
FIG. 3 is an is an enlarged plan view of the marking machine in the position shown in FIG. 2.
Figure 4:
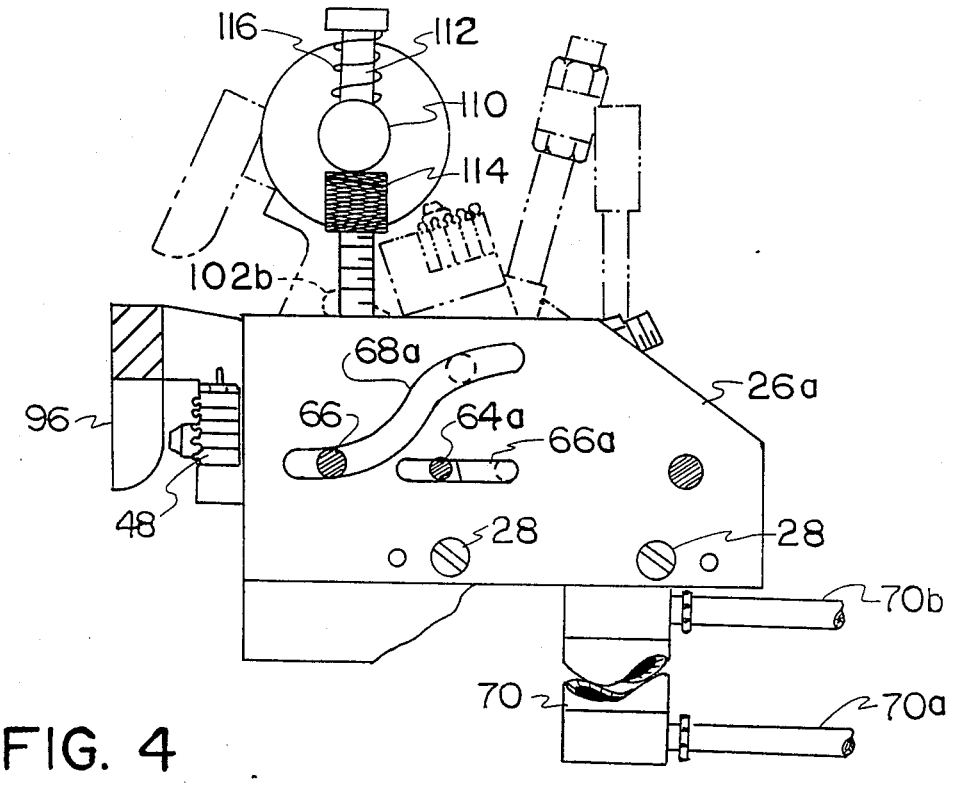
FIG. 4 is a reduced view taken along line 4—4 of FIG. 3 showing the mechanism in the lowered printing position in solid lines and in the raised ready position in broken lines.
Figure 5:
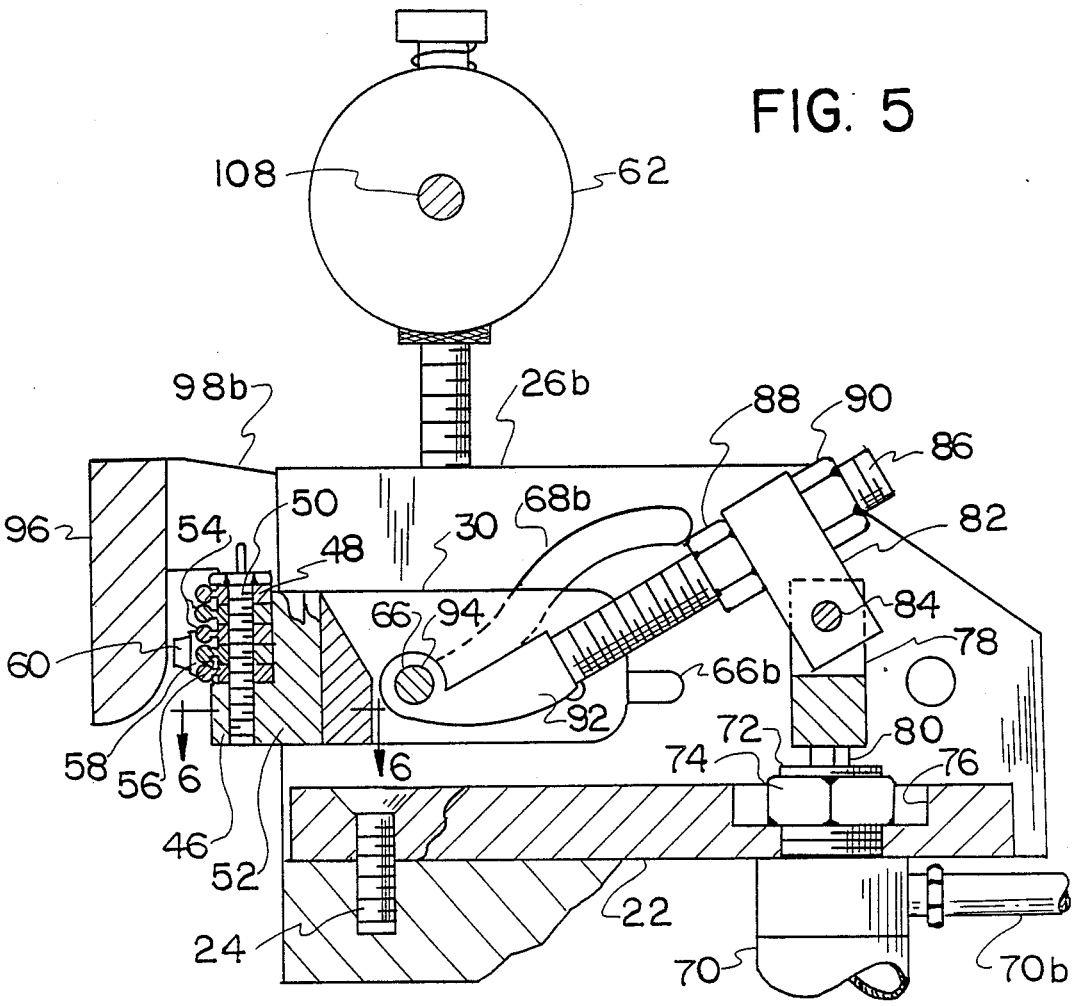
FIG. 5 is a view partly in section taken along line 5—5 showing details of the print head and removable type holder.
Figure 6:
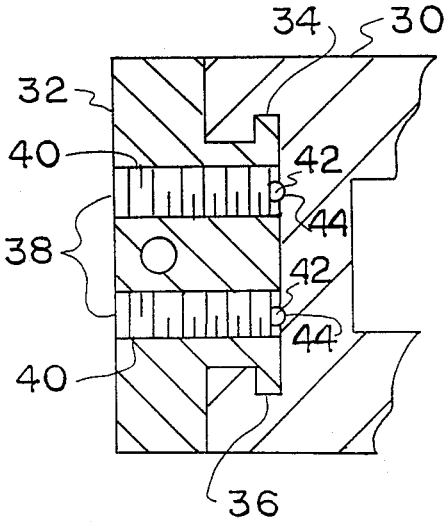
FIG. 6 is an enlarged partial view taken along line 6—6 of FIG. 5 showing the manner in which the type holder is frictionally secured within its retaining slot.

Details of the machine 10 are shown in the enlarged views of FIGS. 2–6 and include a horizontal base plate 22 which may conveniently be secured to the frame member 12 by means of screws 24 as shown in FIG. 5. Spaced parallel upstanding side plates **26*a* and 26*b* are secured to opposite sides of the base plate 22 such as by screws 28 as shown in FIGS. 2 and 4. To simplify construction, the base plate 22 and the side plates 26*a* and 26*b*** could be formed as a single channel-shaped element.

For purposes of orienting the various parts of the mechanism and their movement, the end of the machine facing the conveyor is designated the front end of the machine along which pass the carton surfaces to be marked. The base is accordingly secured to the conveyor frame so as to position the front edges of the side plates **26*a* and 26*b* close to the path of the carton edges as shown in FIG. 1**.

A print head 30 is disposed between the side plates **26*a* and 26*b*, and means are provided for cooperatively connecting the print head with the side plates to selectively provide a translational and rotational movement of the print head in a cyclical fashion as will be presently described. In the preferred embodiment, the print head 30 comprises, as viewed in plan, a substantially U-shaped member with its open end facing rearwardly. The forward end of the print head includes a demountable type holder 32 (FIG. 6) which is captively secured to the print head 30 by means of an undercut groove 34 into which the flanged rear portion 36 of the type holder 32 is slideably positioned. Stop means (not shown) limit the downward travel of the type holder 32 and friction means in the form of a pair of threaded friction elements 38 are threadedly mounted in the threaded bores 40 of the type holder 32. Resilient inner tip elements 42 of the friction members 38 seat in recesses 44 of the print head 30 when the type holder is fully seated in the vertically oriented groove 34 of the print head. The type holder is accordingly restrained by the resilient elements from moving within the groove 34 during the cyclic movement of the print head but can be readily removed by simply manually sliding the unit upward to overcome the frictional seating force of the elements 42**.

As shown in FIG. 5, the type holder 32 includes a forwardly extending portion 46 on which is supported a vertical stack of type bars 48 which are secured in position by a vertical screw 50 passing therethrough and into the threaded bore 52 of the type holder. The bars 48 each have a rail like portion 54 protruding from the forward edge thereof, the rails 54 serving to secure therebetween the rearwardly directed retaining flanges 56 of the resilient type element 58 carrying the forwardly directed type face 60 in a substantially vertical attitude. The type element 58 is accordingly securely attached to the type holder 32, but can readily be changed or added to by simply loosening the screw 50 to allow the sliding release of the type element from between the bars 48 and the introduction of new elements.

The basic operation of the marking machine involves the cyclical movement of the print head 30, which movement culminates in a short linear horizontal printing stroke wherein the print head moves forwardly into the printing position shown in FIG. 5 with the type holder extending well beyond the front end of the side plates 26*a* and 26*b*. In this position the type face 60 resiliently engages the carton on the conveyor 14 and the inked indicia is transferred from the type face 60 onto the carton surface. The printing stroke is followed by a retraction stroke wherein the print head is initially moved linearly rearwardly, following which a pivotal movement of the print head rotates the print head clockwise as viewed in FIG. 5 to engage the type face 60 with an ink roll 52 disposed thereabove. The linear and rotational paths of motion of the print head 30 are controlled by guide means on the side plates 26*a* and 26*b* in cooperation with guide elements projecting laterally from the print head. These guide means and guide elements as well as the drive mechanism for producing movement of the print head will now be described.

The guide elements on the print head include front and rear guide elements extending from each side of the print head which cooperatively engage guide means on the side plates 26*a* and 26*b*. In the illustrated embodiment, the rear guide elements comprise the axially aligned guide pins 64*a* and 64*b* which extend laterally from opposite sides of the print head 30. The guide means on the plates 26*a* and 26*b* cooperatively receiving the pins 64*a* and 64*b* comprise horizontal slots 66*a* and 66*b* in the respective side plates 26*a* and 26*b*. The slots 66*a* and 66*b* are in parallel alignment and are sized to permit a sliding as well as a rotating movement of the pins disposed therewithin.

The forward guide elements on the print head comprise the opposite extending ends of an actuating shaft 66 which extends transversely through a bore in the print head. As shown in FIG. 3, the actuating shaft 66 extends through guide means in the side plates in the form of aligned S-shaped slots 68*a* and 68*b* respectively in the side plates 26*a* and 26*b*. The forward ends of the slots 68*a* and 68*b* are linear and are aligned with the horizontal slots 66*a* and 66*b* so that the motion of the print head is linear and horizontal when the shaft 66 enters the lower end of the slots 68*a* and 68*b*, for example in the position shown in FIGS. 3 and 5.

The upper portions of the slots 68*a* and 68*b* are shaped in an arcuate curve having a radius equal to the spacing between the centers of the pins 64 and the shaft 66, the center of these curved slot portions being the center of the pins 64*a* and 64*b* when they are against the rear end of their respective slots as shown in FIG. 2 and in broken lines in FIG. 3. When the pins are in this position, the movement of the print head is essentially a pivotal movement about the pins. The lower portion of the slots 68*a* and 68*b* are shaped in a reverse curve to provide a smooth transition from the arcuate upper portion and the horizontal forward slot portions The drive means for producing the cyclical motion of the print head from a raised ready position adjacent the ink roller 62 to the printing position and back to the ready position comprises a pneumatic cylinder 70 disposed substantially vertically beneath the base plate 22 toward the rear thereof. The threaded upper end 72 of the cylinder extends through a bore in the base plate to permit the attachment of the cylinder to the base plate by means of nut 74 seated in counterbore 76. A yoke 78 is secured to the upper end of the cylinder rod 80, permitting the pivotal attachment of link 82 thereto by means of pivot pin 84 passing through the yoke and link. A threaded actuating rod 86 passes through a bore in the link 82 and is adjustably connected thereto by means of nuts 88 and 90 thereon at opposite sides of the link. The forward end of the actuating rod 86 is pivotally connected to the actuating shaft 66 by means of the end fitting 92 which threadedly receives the rod 86 and includes a transverse bore 94 for passage of the actuating shaft 66.

When compressed air is admitted to the bottom of the cylinder 70 through the air line 70*a*, the cylinder rod 80 is moved upwardly from the position shown in FIG. 5 to the position shown in FIG. 2. Due to its connection by means of rod 86, link 82 and yoke 78 to the rod 80, the print head 30 is, during the upward motion of the cylinder rod 80, moved initially horizontally rearwardly, and thence is rotated clockwise during the rearward movement until the pins 64*a* and 64*b* reach the rear of the slots 66*a* and 66*b*, whereupon the motion of the print head is rotational about the pins. When the cylinder rod 80 reaches the upper end of its stroke, the print head 30 as shown in FIGS. 2 and 3 and in broken lines in FIG. 4 is in a nearly upright rest position. During its motion into this position, the type face passes across the ink roll 62 to ink the face of the type.

When air is introduced to the upper end of the cylinder through the air line 70*a*, the motion of the print head 30 is the reverse of that just described, the head first rotating about the pins 64*a* and 64*b* and thence continuing to rotate while advancing forwardly until reaching the printing position shown in FIG. 3. This movement, which is referred to as the printing stroke of the mechanism, again takes the type face across the ink roll to assure a fresh supply of ink on the type face.

Since the cartons to be marked are lightweight and flexible, some means is required to support the surface to be marked against the advance of the print head so that solid contact of the type face with the carton surface will occur. This support means in the present machine comprises a backer plate 96 extending between the front ends of backer plate support arms 98*a* and 98*b* which extend respectively outboard of and parallel to the side plates 26*a* and 26*b*. The support arms are pivotally connected to the side plates by screws 100*a* and 100*b* passing through bores in the rear ends of the arms into threaded bores within the side plates. Means are provided on the support arms 98*a* and 98*b* cooperating with the print head drive mechanism for rotating the support arms and hence the backer plate 96 about the pivot screws 100*a* and 100*b* during and in synchronism with the movement of the print head. This latter means comprises slots 102*a* and 102*b* respectively in the support arms 98*a* and 98*b*, which slots receive the extending ends of the actuating shaft 66 and permit sliding movement of the shaft therewithin. Stop elements 104 on the ends of the actuating shaft 66 prevent axial migration of the shaft from the mechanism which would otherwise be possible since the shaft is rotatably disposed within the print head 30.

The slots 102*a* and 102*b* are substantially horizontal when the arms and backer plate are in the printing position as shown in FIGS. 1 and 5, and hence the lifting movement of the support arms and backer plate is coincident with the movement of the print head although of a smaller angular degree in view of the difference in pivot point location. As can be seen from FIGS. 2 and 3, the elevated position of the support arms and backer plate which occurs during the ready position of the print head, holds the backer plate 96 well clear of the region in front of the machine through which the cartons pass on the conveyor.

As shown in FIGS. 1 and 2, the forward lower portions of the support arms 98*a* and 98*b* are cut away at 106 to provide clearance for the edges of the cartons when the support arms are in the lowered printing position. The support face 96*a* of the backer plate 96 is curved at its lower edge to facilitate the entry of the backer plate into the carton. A slight lateral misalignment of the carton on the conveyor 14 can thus be accommodated by the backer plate surface 96*a* which will engage the inner face of the carton and either deform the flexible carton or pull the entire carton into the correct lateral position.

The ink roll 62 which is preferably a cylindrical felt roll, is mounted for rotation on the shaft 108 extending between shaft end fittings 110. The fittings 110 and hence the ink roll 62 and its shaft 108, are mounted on vertical rods 112 passing slideably through bores in the fittings 110. The rods 112 are threadedly engaged into threaded bores in the side plates 26*a* and 26*b* at their lower ends. Knurled adjustment screws 114 on the lower threaded portion of the rods 112 support the fittings 110 and may be raised or lowered to adjust the height of the ink roll 62 and thus control its engagement with the type face of the print head. Springs 116 on the upper ends of the rods 112 extend between enlarged upper ends of the rods and the fittings 110, thus serving to bias the roller downwardly into resilient engagement with the type face as the print head moves thereagainst.

The operation of the machine is as follows. As cartons advance toward the marking station, the machine mechanism is in the ready position illustrated in FIG. 2 with the cylinder rod 80 raised upwardly thereby lifting the backer plate 96 into its elevated position and the print head 30 into its raised position, thus clearing the region in front of the machine for movement of a carton into the marking position. When the pneumatic sensing switch senses the presence of the carton in the marking station, the valve admits air pressure into the air line 70*b*, thus lowering the cylinder rod 80 and simultaneously lowering the backer plate 96 and the print head 30. Since the slots 102*a* and 102*b* of the backer plate support arms will be in alignment with the forward end of the slots 68*a* and 68*b* of the side plates during the last portion of the forward travel of the print head, the backer plate will accordingly already be lowered into its backing position when the print head brings the type face into engagement with the carton surface. This assures that the carton will be motionless and supported at the time of engagement of the type to allow a clean printing of the indicia onto the carton.

Upon completion of the printing stroke, a conventional delay valve in the pneumatic system automatically introduces compressed air into the lower cylinder air line 70*a* and relieves the pressure in the upper line 70*b*, thus returning the backer plate and print head to the ready position. The passage of the print head past the inking roll as indicated above provides an inking of the type face both in the printing and return strokes of the print head. With the backer plate 96 raised from the printed carton, the conveyor can continue its incremental movement, bringing a successor carton into the marking station, whereupon the described cycle is again repeated.

The actuating mechanism for the cylinder may be a pressure sensitive switch as described positioned along the conveyor to sense the carton position, or may be another sensing mechanism such as an electrical switch similarly positioned and connected with a solenoid valve to control air to the cylinder 70. In any case, installation of the device is relatively simple and involves no modification of the conveyor mechanism, thus permitting the machine to be used with a wide variety of packaging machines.

An important feature of the invention is the positioning of the ink roll above the mechanism where its condition can be easily seen and adjustments readily made. Similarly, the upwardly facing position of the print head in the ready position permits the easy inspection and changing of the type face. Changing of the type element 58 may be quickly accomplished by simply sliding the type holder 32 from the print head, loosening the screw 50 and sliding the desired type elements into the desired position on the type holder, retightening the screw 50, and replacing the type holder in the print head.

Although the type holder and type element are shown presenting the type face in a substantially vertical attitude in the printing position, these elements could be angularly mounted on the print head to accommodate an angled face of a carton.

Also, although the pneumatic cylinder is shown as a double acting cylinder, a single acting cylinder with spring return could be substituted to provide the same actuating functions.

As mentioned above, the invention contemplates presenting the type face in an angular attitude; i.e. wherein it is oriented so that it faces upwardly or alternatively faces downwardly. In both orientations the backer plate is also compatibly angularly oriented so as to properly serve its backing function. The foregoing is accomplished by modifying the previously described print head and backer plate. Such a modification is shown in FIGS. 7 and 8.

Figure 7:
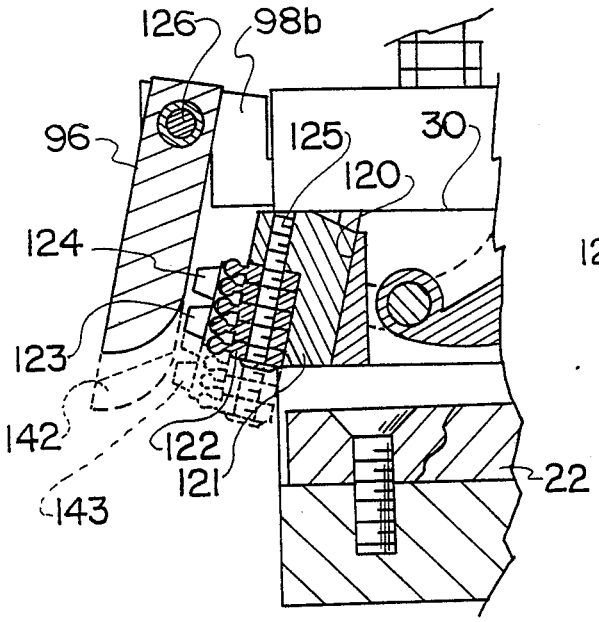
FIG. 7 is an enlarged partial view (similar to FIG. 6) illustrating a modified print head wherein the type face is oriented to face upwardly.
Figure 8:
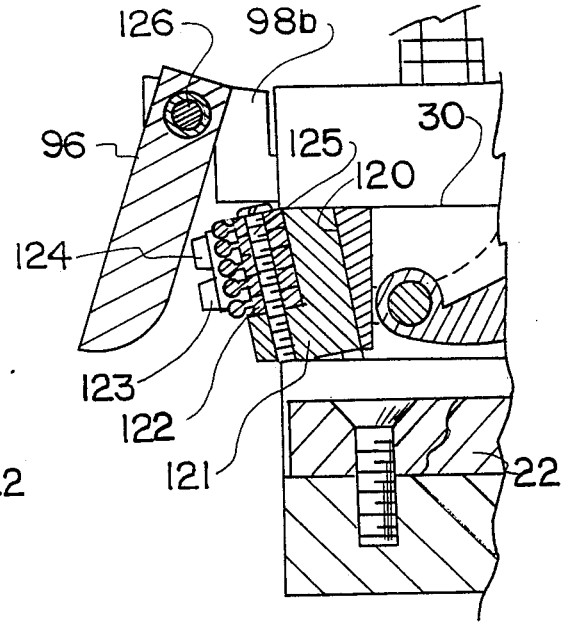
FIG. 8 is a view similar to FIG. 7 wherein the type face is oriented to face downwardly.

In FIGS. 7 and 8 the undercut groove 34 in the print head 30 is cut at an angle so that when the print head is in the print condition the groove has a substantially angular attitude with respect to the vertical. The latter undercut groove is indicated at 120 in Figures 7 and 8. The difference in orientation of the groove 120 as between FIGS. 7 and 8 will be noted later.

The type holder 121 has a structure similar to the previously described type holder 32. Flanges on the holder 121 extend into the undercut groove 120. These flanges are not shown but are identical to flange 36. The type holder 121 can be mounted or removed from the type holder simply by sliding in the groove 120. Detent means similar to the threaded friction elements 38 with tip elements seating in recesses are employed to hold the type holder 120 in position.

The type holder 121 carries a stack of print bars 122 which mount the type element 123 having a type face 124. The bars 122 and type element 122 are held on the type holder by the screw 125. The type face 124, of course, extends parallel to the undercut groove 120.

In the modification of FIGS. 7 and 8, the backer plate 96 is mount on the support arms 98*a* and 98*b* so that the plate can be angularly shifted and locked in the desired position. This is accomplished by the use of a pair of bolts, the shanks of which are threaded in the backer plate and the heads of which bear on the arm 98*a* and 98*b*. When the bolts are loosened, the backer plate can be oriented to the desired position and then locked. In FIGS. 7 and 8 one of the bolts is noted at 126.

In FIG. 7, it will be seen that the type face is oriented to face upwardly. This position is for marking the outside of egg carton covers of the type wherein the wall is substantially slanted. The back plate 96 has been adjusted to the proper angle with respect to the type face.

The manner in which the type face as oriented to face downwardly as in FIG. 8 will now be explained.

As will be apparent from the previous description, the print head 30 is symmetrical and can be turned over 180° between the side plates. Thus, in FIG. 8 the print head has to be turned 180°. Accordingly the undercut groove 120 and type face are oriented downwardly. With this arrangement the marker is adapted to mark the outside wall of a separator in a filler flat.

Figure 9:
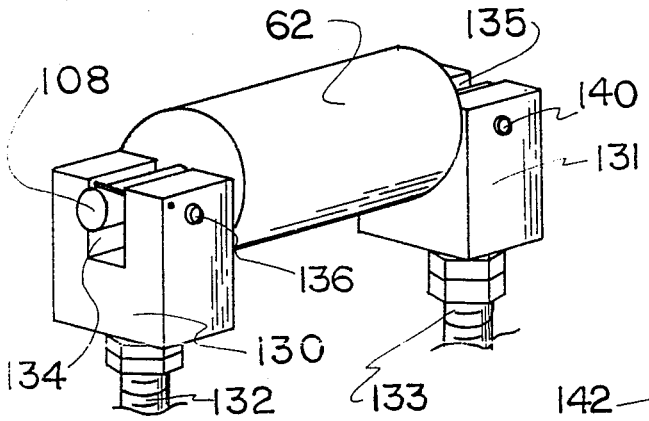
FIG. 9 is a perspective view illustrating a modified ink roll assembly with the inking roller in operating position.
Figure 10:
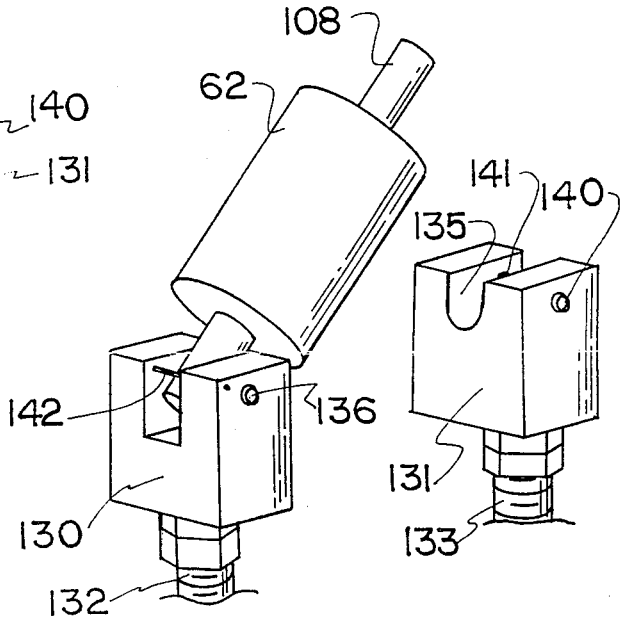
FIG. 10 is a view similar to FIG. 9 wherein the inking roller is being moved to a load/unload position.

In FIGS. 9 and 10 I have illustrated improved structure for mounting the ink roll 62.

A pair of standards 130 and 131 are mounted on studs 132 and 133 plate 26*a* and 26*b*. The standard 130 has a groove 134 and the standard 131 has a groove 135. A pivot pin 136 extending across groove 134 rotatably mounts one end of the ink roller shaft 108.

The opposite end of the shaft 108 is disposed in the groove 135 of standard 131. Spring loaded detent means 140 and 141 in standard 131 releasably hold the shaft 108 in groove 135.

The position of the ink roll 62 as shown in FIG. 9 is the operating position. To change ink roll it is only necessary to rotate the shaft 108 upwardly as shown in FIG. 10. A stop 142 extending across groove 134 limits the upward portion of the roller. This is the load/-remove position wherein roll 62 can be removed, a new roll inserted, and the shaft and roll moved to the operating position.

In certain application of the angled arrangement of FIG. 7, it is necessary to locate the type face 124 downwardly from the position shown. Of course, when the type face is moved downwardly, it is necessary to correspondingly lengthen the back plate 96. The foregoing is indicated in FIG. 7 by the dotted lines 142 and 143.

When the type face is moved downwardly, it is also necessary to change rigid mounting of the inking roller to a flexible or yielding mounting. The reason for this is that the downward positioning changes the radius of the type face from the pivot axis and this causes the type face to unevenly contact the surface of the inking roller. More ink is received by the trailing part of the type face than is received by the leading part of the type face. Accordingly, the imprint on the carton will be uneven in appearance. Also the leading part of the type face may barely touch the inking roller while the trailing type may dig into the roller and cause physical damage.

Figure 11:
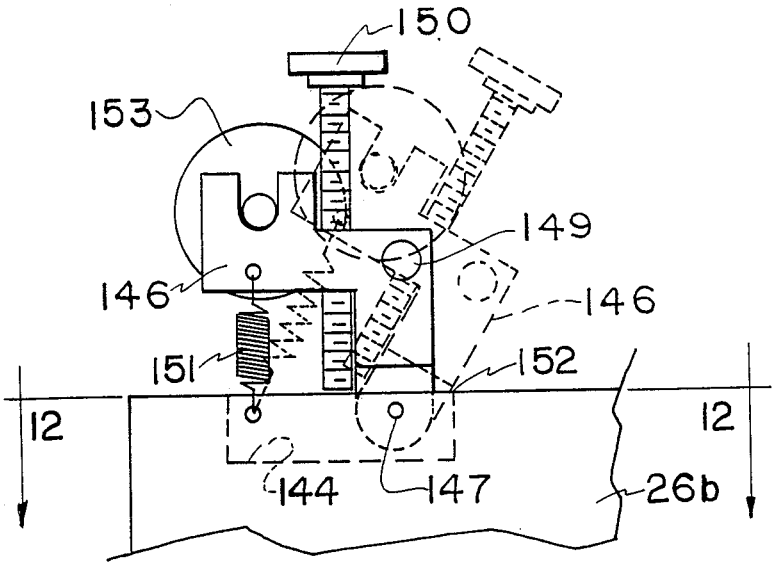
FIG. 11 is a side elevational view illustrating a different support means for the inking roller.
Figure 12:
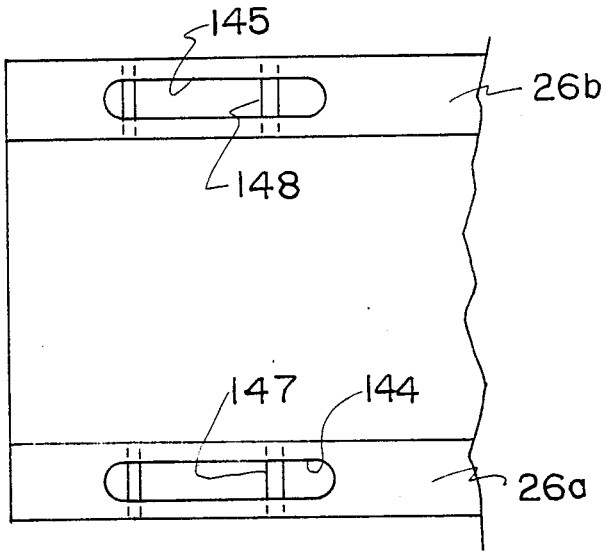
FIG. 12 is a view taken along the lines 12—12 in FIG. 11.

An arrangement for accomodating the foregoing is shown in FIGS. 11 and 12.

The side plates 26*a* and 26*b* have been respectively provided with clearance slots 144 and 145. The slots 144 and 145 respectively receive the lower ends of identical Z-bars, the Z-bar in slot 144 being noted at 146. The lower ends of the Z-bars are pivotally secured in the slots 144 and 145 by the pivots 147 and 148. A connector bar 149 fixedly joins the Z-bars together so that they move in unison with respect to pivots 147 and 148.

The Z-bars can tilt between inactive position and an active position. The inactive position is shown by the fill lines in FIG. 11 and is determined by the adjusting screw 150 which is threaded in the bar 146 and engages the top of side plate 26*a*. A pair of springs hold the Z-bars in the inactive position. The spring for bar 146 is indicated at 151. The spring biases the bars to the inactive position.

The maximum active position is shown by the dotted lines 146*a* and is determined by the bars engaging the top of the slot as indicated for slot 144 at 152. In actual use the Z-bars will move to active positions less than the maximum position.

The inking roller 153 is mounted on the Z-bars similarly as described in connection with FIGS. 9 and 10. The rotational axis of the roller 153 and axes of pivots 147 and 148 respectively lie in spaced apart vertical planes and also lie in spaced apart horizontal planes.

When the inking roller is engaged by the type, the Z-bar mount constrains it to move in a direction defined by horizontal and vertical components. Thus, when the type face 124 is moved up to engage the inking roller, the leading type will cause the inking roller to yield and as the trailing type follows it will engage the roller with the same force and over the area coverage as the leading type. The problems of damage and uneven printing are eliminated.

I claim:

1. A marking machine for imprinting indicia on a carton surface comprising;

a base including upstanding side plates disposed in spaced parallel relation, a print head disposed between said side plates, guide elements extending from said print head and cooperatively engaging guide means on said side plates to define a linear and rotational path of movement of said print head with respect to said base, a demountable type holder secured to said print head for holding a type element thereon, an ink roll supported above said side plates for engagement with the type element carried by said type holder in the raised position of said print head, a backer plate assembly including a backer plate pivotally mounted on said base for movement between a raised standby position and a lowered carton backing position, and selectively actuatable drive means including a common connection with said print head and backer plate assembly for cyclically moving said print head from a raised standby position with the type holder adjacent said ink roll to a printing position with the type holder extending beyond the side plates into engagement with a carton surface, said drive means moving said backer plate assembly into its lowered carton backing position so as to provide rigid support to the carton surface at the time of engagement of the carton by the inked type element carried by said print head type holder, said drive means serving to return said print head and said backer plate assembly to their raised standby positions.

2. The invention as claimed in claim 1, wherein said drive means comprises a fluid actuated cylinder.

3. The invention as claimed in claim 1, wherein said drive means comprises a pneumatic cylinder.

4. The invention as claimed in claim 1, wherein said drive means is connected with said print head and said backer plate assembly through a common actuating shaft.

5. A marking machine for imprinting indicia on a carton surface comprising;

a base including upstanding side plates disposed in spaced parallel relation, a print head disposed between said side plates a demountable type holder secured to one end of said print head for holding a type element thereon, guide elements extending transversely from said print head and cooperatively engaging slots on said side plates to define a linear and rotational path of movement of said print head with respect to said base, said path of movement extending between a printing position wherein the type holder is advanced against an adjacent carton to engage the type element therewith, and a retracted rotated standby position wherein the type element is upwardly directed, an ink roll supported above said side plates for engagement with the type element when the print head moves into the raised standby position, a backer plate assembly including a backer plate pivotally mounted on said base for movement between a raised standby position and a lowered carton backing position, and selectively actuatable drive means including a common connection with said print head and backer plate assembly for cyclically moving said backer plate assembly into its lowered carton backing position while simultaneously moving said print head toward its printing position, said drive means serving to return said backer plate assembly and said print head to their raised standby positions.

6. The invention as claimed in claim 5, wherein said drive means comprises a fluid actuated cylinder.

7. The invention as claimed in claim 5, wherein said drive means comprises a pneumatic cylinder.

8. The invention as claimed in claim 5, wherein said drive means is connected with said print head and said backer plate assembly through one of said guide elements.

9. The invention as claimed in claim 5, wherein said guide elements comprise guide pins extending transversely adjacent one end of said print head into aligned horizontal slots on said side plates, said guide elements additionally comprising a shaft extending through said print head parallel to and spaced from said guide pins, the ends of said shaft extending through curvilinear slots in said side plates.

10. The invention as claimed in claim 9, wherein one end of each said curvilinear slot is horizontally aligned.

11. The invention as claimed in claim 9, wherein said shaft ends extend beyond said side plates into actuating engagement with said backer plate assembly

12. The invention as claimed in claim 11, wherein said backer plate assembly comprises a backer plate, and a pair of support arms connected at one end to said backer plate and pivotally connected at the other end to said side plates, and slots in said support arms through which extend the ends of said actuating shaft.

13. The invention as claimed in claim 12, wherein said slots in said support arms comprise horizontal slots aligned with the horizontal portions of said side plate curvilinear slots when said print head and backer plate assembly are in the lowered printing position.

14. A marking machine for imprinting indicia on a carton surface comprising:

a base including upstanding side plates disposed in spaced parallel relation;

a print head disposed between said side plates, guide elements extending from said print head and cooperatively engaging guide means on said side plates to define a linear and rotational path of movement of said print head with respect to said base;

a demountable type holder secured to said print head;

a type element including type face connected to said type holder;

an ink roll;

means supporting said ink roll above said side plates for engagement with said type face in the raised position of said print head;

a backer plate assembly including a backer plate pivotally mounted on said base for movement between a raised standby position and a lowered carton backing position; and selectively actuatable drive means including a common connection with said print head and backer plate assembly for cyclically moving said print head from a raised standby position with the type face engaging said ink roll to a printing position with the type face in substantial vertical attitude for engaging a vertically oriented carton surface, said drive means moving said backer plate assembly into its lowered carton backing position so as to provide rigid support to the carton surface at the time of engagement of the carton by said face, said drive means serving to return said print head and said backer plate assembly to their raised positions.

15. The marking machine according to claim 14 wherein said means supporting said ink roll comprises:

a pair of standards respectively extending upwardly from said side plates;

threaded stud means respectively connecting said standards with said side plates for vertical adjustment of its standard with respect to the side plate;

a groove formed on the top of each standard;

an inking roller support shaft, one end of which is pivotally mounted in one of said grooves whereby the shaft is moveable between an operating position and a load position; and in said operating position the opposite end of the support shaft extending into the groove on the other standard, in which position the shaft being oriented to support an inking roller for its inking function and in said load position, the support shaft being oriented so that an inking roller can be removed from or placed on the shaft.

16. A marking machine for imprinting indica on a carton surface comprising:

a base including upstanding side plates disposed in spaced parallel relation;

a print head disposed between said side plates, guide elements extending from said print head and cooperatively engaging guide means on said side plates to define a linear and rotational path of movement of said print head with respect to said base;

a demountable type holder secured to said print head;

a type element including type face connected to said type holder;

an ink roll;

means supporting said ink roll above said side plates for engagement with said type face in the raised position of said print head;

a backer plate assembly including a backer plate pivotally mounted on said base for movement between a raised standby position and a lowered carton backing position; and selectively actuatable drive means including a common connection with said print head and backer plate assembly for cyclically moving said print head from a raised standby position with the type face engaging said ink roll to a printing position with the type face in substantial angular attitude with respect to the vertical for engaging an angularly oriented carton surface, said drive means moving said backer plate assembly into its lowered carton backing position so as to provide rigid support to the carton surface at the time of engagement of the carton by said face, said drive means serving to return said print head and said backer plate assembly to their raised standby positions.

17. The marking machine according to claim 16 wherein said means supporting said ink roll comprises:

a pair of standards respectively extending upwardly from said side plates;

threaded stud means respectively connecting said standards with said side plates for vertical adjustment of its standard with respect to the side plate;

a groove formed on the top of each standard;

an inking roller support shaft, one end of which is pivotally mounted in one of said grooves whereby the shaft is moveable between an operating position and a load position; and in said operating position the opposite end of the support shaft extending into the groove on the other standard, in which position the shaft being oriented to support an inking roller for its inking function and in said load position, the support shaft being oriented so that an inking roller can be removed from or placed on the shaft.

18. The marking machine of claim 16 wherein said type holder is secured to said print head by an undercut groove in the print head and a flange portion on the type holder slideably positioned therein, the undercut groove having a substantially angular attitude with respect to the vertical.

19. In a marking machine for imprinting indicia on a carton surface:

base means;

a print head disposed on said base means;

means interconnecting said print head with said base means to provide relative motion of the print head with respect to the base means as between a print condition and a standby condition;

a type face removably mounted on said print head and having a predetermined angular orientation with respect to the vertical; and said interconnecting means providing for the print head to be alternatively in either one of two positions, in one of said positions said type face, when the print head is in the print condition, being oriented to face angularly upwardly and in the other of said positions said type face, when the print head is in the print condition, being oriented to face angularly downwardly.

20. In a marking machine for imprinting indicia on a carton surface:

a base including upstanding side plates disposed in parallel relation;

a print head disposed between said side plates;

means interconnecting said print head with said side plates to provide relative motion of the print head with respect to side plates as between a print condition and a standby condition;

a type face mounted on said print head having a predetermined angular orientation with respect to the vertical; and said interconnecting means providing for the print head to be alternatively in either one of two positions in one of said positions said type face, when the print head is in the print condition, being oriented to face angularly upwardly and in the other of said positions said type face, when the print head is in the print condition, being oriented to face angularly downwardly.

21. In a marking machine for imprinting indicia on a carton surface:

a base including upstanding side plates disposed in parallel relation;

a print head disposed between said side plates;

means interconnecting said print head with said side plates to provide relative motion of the print head with respect to side plates as between a print condition and a standby condition;

means on said print head forming an undercut groove having a predetermined angular orientation with respect to the vertical;

a type holder having a type face, the holder being slideably mounted in said undercut groove and the type face extending generally parallel with said undercut groove; and said interconnecting means providing for the print head to be disposed between said side plates alternatively in either one of two positions, in one of the positions said type face, when the print head is in the print condition, being oriented to face angularly upwardly and in the other of the positions said type face, when the print head is in the print condition, being oriented to face angularly downwardly.

22. In a marking machine for imprinting indicia on a carton surface:

means to support type face for movement as between a raised standby position to a lowered printing condition;

a pair of standards respectively extending upwardly;

a groove formed on the top of each standard;

an inking roller support shaft, one end of which is pivotally mounted in one of said grooves whereby the shaft is moveable between an operating position and a load position; and in said operating position the opposite end of the support shaft extending into the groove on the other standard, in which position the shaft being oriented to support an inking roller for its inking function and in said load position, the support shaft being oriented so that an inking roller can be removed from or placed on the shaft.

23. The marking machine of claims 1, 5, 14, or 16 wherein said ink roll is on a horizontal axis mounted by support means providing for the ink roll, when engaged by the type face, to be moved in a direction defined by horizontal and vertical components.

24. The marking machine of claim 23 wherein said support means comprises a pair of rigidly connected pivotally mounted spaced apart bars, the pivot axis of the bars and the rotational axis of the roll lying in spaced apart vertical planes.

* * * * *